United States Patent [19]

Chiarappa

[11] 3,979,790

[45] Sept. 14, 1976

[54] TOTALLY ENCLOSED DOOR CHECK

[75] Inventor: Ralph F. Chiarappa, Schaumburg, Ill.

[73] Assignee: Vapor Corporation, Chicago, Ill.

[22] Filed: Oct. 6, 1975

[21] Appl. No.: 619,725

[52] U.S. Cl. ..... 16/84; 188/318

[51] Int. Cl.[2] ..... E05F 3/12

[58] Field of Search ..... 16/51, 66, 84; 188/313, 188/318

[56] References Cited

UNITED STATES PATENTS

| | | | |
|---|---|---|---|
| 2,239,112 | 4/1941 | Nickelsen | 188/318 |
| 2,790,991 | 5/1957 | Schlage | 188/318 |
| 2,834,039 | 5/1958 | Sasse | 188/318 |
| 3,010,433 | 11/1961 | Codling | 16/66 |
| 3,199,637 | 8/1965 | Herman | 188/318 |
| 3,380,110 | 4/1968 | Daugirdas et al. | 16/66 |
| 3,471,140 | 10/1969 | Ballard | 188/318 |
| 3,722,920 | 3/1973 | Reese | 188/134 |
| 3,887,961 | 6/1975 | Saajos | 16/51 |

*Primary Examiner*—Werner H. Schroeder
*Assistant Examiner*—Conrad L. Berman
*Attorney, Agent, or Firm*—Francis J. Lidd

[57] ABSTRACT

A check assembly using compressible fluid for linearly dampening the closing movement of a door includes a cylindrical, hollow housing having a cavity defined therein with first and second ends. Slidably mounted within the cavity and attached to the door is a piston of substantially the same cross-sectional area as the cavity. The piston has flap-type, relief check valves allowing free passage of compressible fluid through the piston only during motion of the piston in the door opening mode. The check assembly further includes longitudinal grooves fabricated circumferentially around the cavity and of a dimension such that the seal of the piston against the cavity wall is broken at different points during movement of the piston allowing compressible fluid to flow from one side of the piston to the other. Finally, the check assembly includes a fluid bypass continuously communicating compressible fluid from one end of the cavity to the other thereby defining a closed loop system. The bypass includes a variable orifice comprising an orifice and a needle valve such that the rate of fluid flow through the bypass may be adjusted to allow the same assembly to be used with doors of different weights and to compensate for linkage wear.

7 Claims, 3 Drawing Figures

TOTALLY ENCLOSED DOOR CHECK

BACKGROUND OF THE INVENTION

1. Field of the Invention

The device of the present invention relates to a new and improved assembly for linearly checking or dampening the closing motion of doors of variable weights and to a new and improved method for obtaining linear dampening of the closing motion of such doors.

2. Description of the Prior Art

Presently, at least one of the doors, typically the rear door, of a transit vehicle such as a bus is of the push-open, spring-close type. A passenger desiring to depart from the vehicle may manually push the doors open, and, upon release of the doors after departure, a spring functions to close the doors to their original position. If a passenger departing such a vehicle releases the doors and they close too rapidly, a second passenger preparing to leave the vehicle may be struck and harmed by the closing doors.

The rapid closing of the doors may occur in checking assemblies using compressible fluid, since during the initial closing motion of the doors the piston in the checking assembly is compressing a large volume of the fluid and sufficient pressure is not immediately developed to dampen the motion of the piston and thus the doors until the volume of compressible fluid has been significantly reduced. For this reason, the initial portion of the closing motion of the doors may be more rapid than desired.

It is also possible to open the doors partially and allow closure thereafter such that the volume of fluid compressed by the piston is so small that the fluid is not compressed to the proper amount resulting in insufficient dampening of the motion of the piston and thus the doors.

Both of the above conditions result in nonlinear dampening characteristics of checking assemblies using compressible fluid.

In present day systems there are two fluids that are used in checking assemblies for dampening the closing motion of doors. The first is an incompressible fluid such as in a hydraulic system using oil wherein compressibility of the fluid is not a problem. In these systems, as long as there is no air space within the door check cylinder, there will be substantially linear dampening throughout the closing movement of the door. However, hydraulic systems or systems using incompressible fluid are expensive, normally require complicated valving and require frequent adjustment to compensate for temperature variations. In addition, the possibility of leakage is undesirable in highly traveled public areas.

For these reasons, the second type of system, most normally pneumatic systems, are preferable. However, present pneumatic systems are incapable of complete linear dampening throughout the entire closing motion of a door. Moreover, if a single system is to be offered universally for doors of different weights and linkage, wear over a period of time must be compensated for by the system.

A typical pneumatic system is illustrated in U.S. Pat. No. 3,380,110. The typical linkage and check assembly of the type illustrated in this patent are subject to the limitation that the spring extension forces that tend to close the open door and the frictional forces developed by the door during closing are nearly equal in magnitude near the closed door position. This characteristic is a consequence of the design necessary to package a mechanical linkage in the available space above a typical transit bus door. The equality of frictional and spring forces near the door closed position results in tolerance buildups, linkage wear and other variables that combine to prevent the door from reliably closing. This situation, of course, is undesirable in doors used on public transit vehicles.

Additionally, prior art check assemblies such as that disclosed in U.S. Pat. No. 3,380,110 are open loop systems that use as a source of compressible fluid the atmosphere, thus requiring a filter on the inlet orifice. These assemblies also suffer from wear on the piston in the check assembly due to debris introduced into the system from the atmosphere. Furthermore, linear dampening through the entire closing motion is not achieved in such a system.

A typical system that more nearly obtains linear dampening is illustrated in U.S. Pat. No. 3,010,433. Therein is disclosed a checking device using check valve assemblies at both ends of the checking device housing. One of the assemblies controls the vacuum created behind the piston as the door closes. By regulating the magnitude of this vacuum, the piston movement can be initially checked by reducing the amount of air introduced behind the piston. However, such a system is an open loop system resulting in undesired wear on its components. Moreover, different check valve assemblies must be incorporated in the checking device depending on the weight of the door attached to the checking device. Also, change in frictional resistance to the door movement occurs as the linkage wears requiring periodic changing of the check valves since these valves operate as fixed orifices.

As illustration of a hydraulic system employing a bypass is presented in U.S. Pat. No. 3,722,920. This system includes a variable orifice in the bypass. However, a bypass of this type is not utilized to obtain linear dampening of the movement of the piston, but rather to allow increased flow over a predetermined portion of the piston movement.

SUMMARY OF THE INVENTION

An object of the present invention is to provide a new and improved device for dampening the closing motion of a door or the like.

Another object of the present invention is to provide a new and improved method for dampening the movement of a door.

Moreover, another object of the present invention is to provide a new and improved device for linearly dampening pneumatically checked doors throughout the entire closing motion of the door.

Additionally, a further object of the present invention is to provide a closed loop system, pneumatic check assembly that does not require filters on fluid inlets or outlets.

Briefly, the present invention is directed to a new and improved checking assembly or device for linearly dampening the closing motion of a door of the type used on public transit vehicles. The checking assembly includes a hollow, cylindrical housing having two ends. Also included within the check valve housing is a movable piston of a cross-sectional area substantially equal to the cross-sectional area of the cavity within the housing. In addition, the piston is attached to the door such that movement in one direction is imparted to the piston upon opening the door and movement in the opposite direction is imparted to the piston upon door closure.

Also included is a spring attached to the door such that upon release of the door after opening, the spring exerts a force to close the door.

Fabricated circumferentially within the inner periphery of the housing wall is one or more grooves or slots that increase the cross-sectional area of the cavity or interior of the housing such that, as the piston approaches each groove, the seal between the outer periphery of the piston and the inner circumferential periphery of the cavity is broken allowing compressible fluid to flow from one side of the piston to the other.

In accordance with an important feature of the present invention, there is included in the check valve assembly a bypass that interconnects each end of the cylinder within the check valve housing thereby allowing continuous fluid flow from one end of the cavity to the other.

In addition, included within the bypass is a variable orifice that may be adjusted to control the flow rate of fluid through the bypass.

BRIEF DESCRIPTION OF THE DRAWING

The above and other objects and advantages and novel features of the present invention will become apparent from the following detailed description of a preferred embodiment of the invention illustrated in the accompanying drawing wherein.

DESCRIPTION OF THE PREFERRED EMBODIMENT

Figures 1, 2, 3:
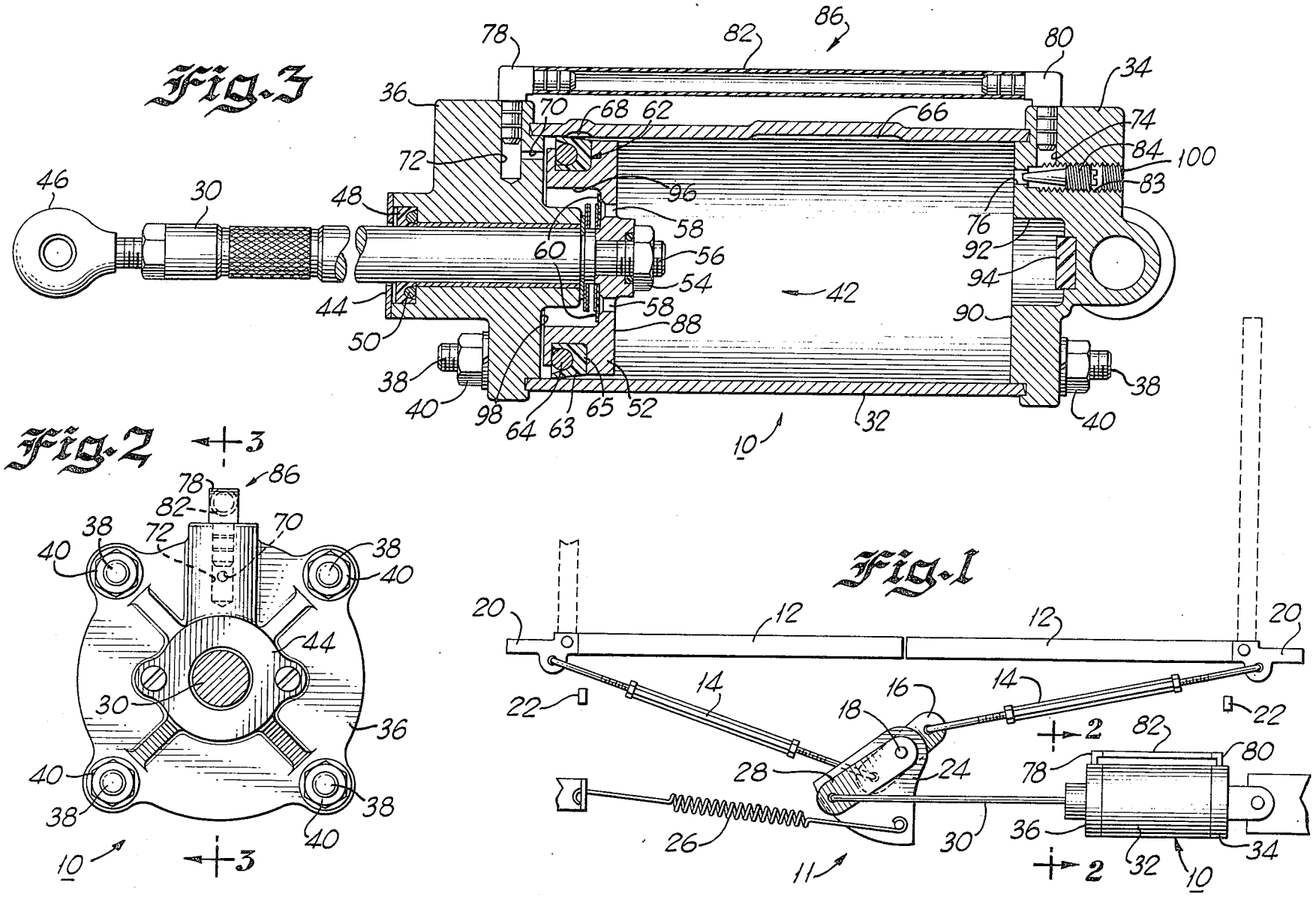
FIG. 1 is a plan view of a door check system employing a door check constructed in accordance with the principles of the present invention.
FIG. 2 is an enlarged view of the device of the present invention taken along line 2—2 of FIG. 1.
FIG. 3 is a cross-sectional view of the device of the present invention taken along line 3—3 of FIG. 2.

With reference to the drawing, there is illustrated a new and improved door check 10. Typically, an assembly such as door check 10 is employed in transit vehicles for dampening the closing motion of push-open, spring-closed doors 12 in transit vehicles such as buses (FIG. 1).

In a typical door system 11 of this type, the outwardly swinging doors 12 are each connected by rods 14 to a teeter lever 16. Teeter lever 16 pivots about a shaft 18 such that upon opening motion of the doors 12 due to a passenger exiting the vehicle, teeter lever 16 is rocked about shaft 18. The opening motion of doors 12 is limited by the abuting of extensions 20 of doors 12 against stops 22. This rotation of the teeter lever 16 imparts rotational movement to a cam plate 24 that is also secured to shaft 18. This movement imparted to cam plate 24 upon opening of the doors 12 causes extension of the spring 26.

The door system 11 is connected to the door check assembly 10 by a crank arm 28 that rotates about shaft 18 upon opening of the doors 12 and is connected to piston rod 30. During this rotation of crank arm 28, piston rod 30 is moved toward the interior of the door check assembly 10. After egress of the passenger and release of the doors 12, the door system 11, under the influence of spring 26, rotates forcing doors 12 to their closed position. At the same time, rod 30 is pulled out of the interior of the door check assembly 10.

The door system 11, as discussed above, is well known in the prior art and a more detailed description of the operation of the assembly may be obtained by referring to U.S. Pat. No. 3,380,110.

In order to prevent slamming of the doors 12 during their closing motion and to dampen the closing motion, door check 10 is employed. Check assembly 10 includes, in a preferred embodiment, a cylindrical housing 32 including end portions 34 and 36. The end portions 34 and 36 may be secured to the cylindrical housing 32 by bolts 38 and nuts 40.

End portion 36 includes an aperture 44 through which extends piston rod 30. Piston rod 30 includes at one end thereof an eye hook 46 that may be secured to the crank arm 28 in a manner well known in the art. In this manner, the piston rod 30 is mechanically linked to the opening and closing motion of the doors 12. The aperture 44 is sealed around the piston rod 30 by an elastomeric ring 48 and an O-ring 50 to prevent the escape of compressible fluid from the cavity 42 and the passage of contaminants from the atmosphere into cavity 42.

At the opposite end of rod 30, there is attached a piston 52 by means of a nut 54 and threaded end portion 56 of rod 30.

In order to have free motion of the piston 52 in the door opening mode, the door check assembly 10 must present little resistance to opening of the doors 12. Toward this end, a plurality of orifices 58 are fabricated in the piston 52. These orifices 58 each define a relief check valve of the flapper type incorporating flappers 60. Upon movement of the piston 52 in the door opening mode, the piston 52 moves from left to right as viewed in FIG. 3. The compressible fluid present in the portion of the cavity 42 on the righthand side of the piston 52 (FIG. 3) is able to pass through the orifices 58 forcing flappers 60 out of sealing engagement thereby allowing essentially unrestricted flow of fluid through the piston 52. Accordingly, as the doors 12 are opened by an individual departing the transit vehicle, piston 52 moves with little or no resistance.

In order to compensate for machining tolerances and to provide a reliable seal between the piston and the inner peripheral surface of the cylinder housing 32, a seal 62 comprising an elastomeric piston cup 63 and an O-ring 64 is positioned within a recess 65 fabricated in the circumferential edge of piston 52. The O-ring 64 secures the piston cup seal 63 to the piston 52 and expands the edges of the piston cup seal 63 against the inner peripheral surface of the housing 32. Consequently, during movement of the piston 52, compressible fluid may not escape around the edges of the piston 52.

In order to have rapid and reliable door closing, the door closure mode should preferably include an interrupted slow movement wherein the doors 12 initially close slowly followed by a more rapid closing motion interrupted by another slow movement portion of the doors. Finally, at the end of the door closing motion, the doors 12 rapidly close ensuring reliable closing.

To accomplish this controlled and variable closing speed of the doors 12 there is fabricated on the inner peripheral surface of the housing 32 one or more elongated grooves or blisters 66 and 68. These blisters may extend longitudinally along the inner peripheral surface of the housing 32. In this configuration, upon the piston 52 reaching the blister 66 during the door closing mode, the seal between the inner peripheral surface of the housing 32 and the cup seal 63 is broken allowing compressible fluid to flow from the left to the right side of the piston 52. This decreases the volume of fluid to be compressed by the movement of the piston 52 allowing the piston 52 to move at a faster rate.

The blister 68 is positioned such that at approximately the fully closed position of the doors 12 the rate of movement of the piston 52 is increased causing a slamming type of movement insuring a reliable closure of doors 12.

The geometry of the door closure system 11 (FIG. 1) wherein the entire system 11 must necessarily be enclosed in a small space above the vehicle door results in the spring 26 exerting a large door closing force while the doors 12 are in their full open position and a corresponding reduction of this spring force as the doors 12 approach their closed condition. Consequently, as tolerance to closing varies due to linkage wear and other variables, the doors 12 may no longer reliably close. In order to overcome this problem and in accordance with an important feature of the present invention, end portion 36 includes a channel network including unrestricted orifice 70 and vertical unrestricted orifice 72. Similarly, end portion 34 includes orifices 74 and 76. Pressed into orifice 72 is barb fitting 78 that is, in a preferred embodiment, of an elbow configuration. Similarly, pressed into orifice 74 is barb fitting 80. Sealably connected to the opposite ends of barb fttings 78 and 80 is an elongated bypass tube 82.

In accordance with a further important feature of the present invention, end portion 34 further includes a threaded orifice 83 into which is threaded a needle valve 84. During opening and closing of doors 12, the piston 52 moves within the cavity 42 and in any given position divides the cavity 42 into two chambers. One chamber is defined on the righthand side, and the second is defined on the lefthand side of the piston 52.

The bypass system 86, that includes orifices 70, 72, 74 and 76, fittings 78 and 80 and bypass tube 82, functions to linearize the dampening motion of the piston 52. More specifically, in the open position of doors 12, the piston 52, and particularly surface 80 of piston 52, occupies a position adjacent to surface 90 of end portion 34. Moreover, under some conditions, nut 54 and threaded end 56 of rod 30 fit within cavity 92 fabricated in end portion 34 and abut against an elastomeric damper or bumper 94. In this position, there is a large volume of compressible fluid in the portion of chamber 42 defined between the surface 96 of the piston 52 and the inner surface 98 of the end portion 36.

Upon closing of the doors 12 under the influence of spring 26, the piston 52 moves leftward as viewed in FIG. 3 and is dampened by the fluid in the defined chamber being compressed by piston 52. However, due to the large volume and the compressible nature of fluid such as air, the initial movement of piston 52 would not be or only partially dampened. By introducing the bypass system 86, fluid in the chamber 42 defined between the surfaces 98 and 96 flows through the orifices 70 and 72 and the bypass 82 to the orifices 74 and 76 to the portion of the chamber 42 defined by surfaces 88 and 90. In this manner, the rate of compressible fluid introduced behind the piston 52 is controlled by needle valve 84 and a suction or vacuum is created in that portion of cavity 42 defined by surfaces 88 and 90 that serves to restrict the movement of piston 52 during the closing mode. Accordingly, the initial movement of piston 52 can be dampened the desired amount by the needle valve 84 and the initial movement is not dependent upon the volume of fluid that must be compressed during the initial movement of the piston 52.

In accordance with an important feature of the present invention, the needle valve 84 may be threaded to enlarge or decrease the effective size of the orifice 76. In this manner, the rate of fluid introduced behind the piston 52 during the door closing mode can be adjusted thereby controlling the rate of speed of the closing motion of the piston 52, and, thus, the entire closing motion of the doors 12 can be linearized.

The needle valve 84, in the preferred embodiment illustrated, is adjusted by a screwdriver or similar tool, but is located within the aperture 82 and protected by plug 100 such that tampering by unauthorized personnel is minimized. Consequently, a service employee may modify the rate of dampening upon installation of the door check assembly 10 providing on-site adjustment of the door system 11 in accordance with door size and weight. Also, as linkage wear occurs, the needle valve 84 may be adjusted to compensate for faster or slower rate of door closure due to this wear.

In accordance with an important feature of the present invention, the end portions 34 and 36 include no openings to the atmosphere. Accordingly, the housing 32, the end portions 34 and 36 and the bypass system 86 define a closed, cylindrical cavity 42. This provides the system 10 with increased life and avoids maintenance that accompanies fixed orifice and open loop systems.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. In combination with a door movable to open and closed positions a check assembly comprising a housing having a cavity therein closed at the ends thereof and containing compressible fluid, a movable member mounted within said cavity having a cross-section substantially identical to the cross-section of said cavity, means connecting said member to said door such that movement of said door moves said member within said cavity, said member movable in a first direction upon opening of said door and in a second direction upon closing said door, means connected to said door for returning said door to a predetermined position upon said door being opened, means for resisting movement of said member in said second direction, a bypass member placing said ends in fluid communication thereby providing compressible fluid to either of said ends from the other end as required by the movement of said member, and variable orifice means in said bypass member for controlling the flow rate of said fluid in said bypass member and thereby controlling a vacuum behind said member during movement in said second direction.

2. The check assembly of claim 1, said check assembly being a closed system.

3. A method of linearly dampening the closing motion of a door, said door being attached to a dampening assembly comprising a housing having a central chamber therein closed at first and second ends, compressible fluid in the chamber, and a piston slidably mounted in said chamber movable between said ends, said piston being attached to said door, the steps comprising continuously communicating said fluid from a first portion of said chamber between said first end and said piston to a second portion of said chamber between said second end and said piston such that as said piston moves from said first end toward said second end, fluid in said second portion may flow to said first portion of the chamber as said door opens, continuously communicating said fluid from said second portion of said chamber such that as said door closes moving said piston from said second end toward said first end, said fluid in said first portion of the chamber flows to said second portion of the chamber, and controlling the rate of flow of said fluid from said first portion of said chamber to said second portion of the chamber during closing of said door to maintain linear dampening of said door at a desired rate by controlling the magnitude of a vacuum in said second portion of said chamber created by the movement of said second piston.

4. An apparatus using compressible fluid for checking the motion of an element comprising a hollow housing having a cavity therein containing a quantity of compressible fluid, a movable element having first and second sides slidably mounted within said cavity and attached to said element so as to move within said cavity and against said fluid as said element moves, a passage placing said sides of said element in continuous fluid communication and variable orifice means in said passage for controlling the flow rate of said fluid in said passage whereby as said element moves in a given direction, fluid in front of said element in the direction of movement continuously flows to the other side of said member such that said orifice means controls the magnitude of a vacuum on said other side of said element created by the movement of said element thereby controlling the compression of said fluid in front of said element and the resistance to the movement of said element.

5. The apparatus of claim 4 further including at least one groove within said cavity parallel to the direction of travel of said element having a larger transverse dimension than said element.

6. The apparatus of claim 4, said apparatus being a closed system.

7. The apparatus of claim 4, said member including means for resisting movement of said member in only one direction.

* * * * *